US009103345B2

(12) United States Patent
Nagel et al.

(10) Patent No.: US 9,103,345 B2
(45) Date of Patent: Aug. 11, 2015

(54) SUPERSONIC COMPRESSOR ROTOR

(75) Inventors: Zachary William Nagel, Ballston Lake, NY (US); Douglas Carl Hofer, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 1108 days.

(21) Appl. No.: 12/639,036

(22) Filed: Dec. 16, 2009

(65) Prior Publication Data

US 2011/0142592 A1 Jun. 16, 2011

(51) Int. Cl.

| | |
|---|---|
| ***F04D 19/02*** | (2006.01) |
| ***F04D 21/00*** | (2006.01) |
| ***F04D 29/38*** | (2006.01) |
| ***F04D 17/12*** | (2006.01) |

(52) U.S. Cl.
CPC ..... *F04D 21/00* (2013.01); *F04D 17/127* (2013.01); *F04D 19/024* (2013.01)

(58) Field of Classification Search
CPC ..... F01D 1/26; F01D 5/141; F04D 3/00; F04D 3/02; F04D 19/007; F04D 21/00; F04D 29/181; F04D 29/185; F04D 17/164; F04D 19/024
USPC ..... 415/1, 60–62, 68, 69, 143, 181, 415/199.1–199.5, 72; 416/1, 124–126, 128, 416/129, 175, 203, 198 A, 200 A, 176
See application file for complete search history.

(56) References Cited

U.S. PATENT DOCUMENTS

| | | | | |
|---|---|---|---|---|
| 2,579,049 A | | 12/1951 | Price | |
| 2,947,139 A | | 8/1960 | Hausmann | |
| 3,187,816 A | * | 6/1965 | Herman | 416/85 |
| 3,797,239 A | | 3/1974 | Hausmann et al. | |
| 3,879,941 A | | 4/1975 | Sargisson | |
| 4,199,296 A | * | 4/1980 | de Chair | 415/181 |
| 4,463,553 A | * | 8/1984 | Boudigues | 60/268 |
| 4,519,208 A | | 5/1985 | Loisy et al. | |

(Continued)

FOREIGN PATENT DOCUMENTS

| | | |
|---|---|---|
| CN | 1087405 A | 6/1994 |
| CN | 1133936 A | 10/1996 |
| GB | 2099518 A | 12/1982 |

OTHER PUBLICATIONS

Co-pending US Patent Application entitled "Supersonic Compressor", U.S. Appl. No. 12/342,278, filed on Dec. 23, 2009.

(Continued)

*Primary Examiner* — Christopher Verdier
(74) *Attorney, Agent, or Firm* — Andrew J. Caruso

(57) ABSTRACT

Provided is a supersonic compressor having a supersonic compressor rotor including a clockable rotor disk allowing restriction or opening of portions of a fluid flow channel of the rotor in order to enhance performance of the rotor during different operational stages, for example rotor start-up or steady state. The supersonic compressor has a first rotor disk, a second rotor disk and a third rotor disk which share a common axis of rotation. The first and second rotor disks are rotatably coupled, and the third rotor disk is disposed between them. The third rotor disk is independently rotatable relative to the first and second disks, and has a raised surface structure for restricting or opening a portion of the flow channel defined by the three rotor disks and at least two vanes. The flow channel contains a supersonic compression ramp and encompasses the raised surface structure.

14 Claims, 7 Drawing Sheets

(56) References Cited

U.S. PATENT DOCUMENTS

| | | | | |
|---|---|---|---|---|
| 6,901,739 | B2 * | 6/2005 | Christopherson | 60/226.3 |
| 7,293,955 | B2 | 11/2007 | Lawlor et al. | |
| 7,334,990 | B2 | 2/2008 | Lawlor et al. | |
| 7,434,400 | B2 * | 10/2008 | Lawlor et al. | 60/726 |
| 8,137,054 | B2 * | 3/2012 | Hofer et al. | 415/66 |
| 2004/0154305 | A1 | 8/2004 | Lawlor et al. | |
| 2006/0034691 | A1 * | 2/2006 | Lawlor et al. | 416/20 R |
| 2007/0125346 | A1 * | 6/2007 | Vetrovec | 123/563 |
| 2009/0196731 | A1 | 8/2009 | Lawlor | |
| 2010/0158665 | A1 * | 6/2010 | Hofer et al. | 415/66 |
| 2010/0329856 | A1 * | 12/2010 | Hofer et al. | 415/181 |

OTHER PUBLICATIONS

Co-pending US Patent Application entitled "Supersonic Compressor Radial Flow Path", U.S. Appl. No. 12/491,602, filed on Jun. 25, 2009.

Breugelmans, "Transonic Compressors", The Variable Geometry in Supersonic Compressors, vol. 2, 21 pages, Feb. 1988.

PCT International Search Report dated Jan. 11, 2011 and Written Opinion.

Unofficial English translation of Chinese Office Action issued in connection with corresponding CN Application No. 20108006406.8 on Aug. 15, 2014.

* cited by examiner

SUPERSONIC COMPRESSOR ROTOR

RELATED APPLICATION

This application is related to U.S. patent application Ser. No. 12/342,278, now U.S. Pat. No. 8,137,054, and U.S. patent application Ser. No. 12/491,602 filed Dec. 23, 2008 and Jun. 25, 2009 respectively, and which are incorporated herein by reference in their entirety.

BACKGROUND

The present invention relates to compressors and systems comprising compressors. In particular, the present invention relates to supersonic compressors comprising supersonic compressor rotors and systems comprising the same.

Conventional compressor systems are widely used to compress gases and find application in many commonly employed technologies ranging from refrigeration units to jet engines. The basic purpose of a compressor is to transport and compress a gas. To do so, a compressor typically applies mechanical energy to a gas in a low pressure environment and transports the gas to and compresses the gas within a high pressure environment from which the compressed gas can be used to perform work or as the input to a downstream process making use of the high pressure gas. Gas compression technologies are well established and vary from centrifugal machines to mixed flow machines, to axial flow machines. Conventional compressor systems, while exceedingly useful, are limited in that the pressure ratio achievable by a single stage of a compressor is relatively low. Where a high overall pressure ratio is required, conventional compressor systems comprising multiple compression stages may be employed. However, conventional compressor systems comprising multiple compression stages tend to be large, complex and high cost.

More recently, compressor systems comprising a supersonic compressor rotor have been disclosed. Such compressor systems, sometimes referred to as supersonic compressors, transport and compress gases by contacting an inlet gas with a moving rotor having rotor rim surface structures which transport and compress the inlet gas from a low pressure side of the supersonic compressor rotor to a high pressure side of the supersonic compressor rotor. While higher single stage pressure ratios can be achieved with a supersonic compressor as compared to a conventional compressor, further improvements would be highly desirable.

As detailed herein, the present invention provides novel supersonic compressor rotors and novel supersonic compressors which provide enhancements in compressor performance relative to known supersonic compressors.

BRIEF DESCRIPTION

In a first aspect, the present invention provides a supersonic compressor rotor comprising (a) a first rotor disk; (b) a second rotor disk; and (c) a third rotor disk; said first, second, and third rotor disks sharing a common axis of rotation; said first and second rotor disks being rotatably coupled; said third rotor disk being disposed between said first and second rotor disks, said third rotor disk being independently rotatable relative to said first and second rotor disks, said third rotor disk comprising a raised surface structure; said first, second and third rotor disks together with at least two vanes defining a flow channel encompassing the raised surface structure of the third rotor disk; said flow channel comprising a supersonic compression ramp.

In a second aspect, the present invention provides a supersonic compressor rotor comprising (a) a first rotor disk; (b) a second rotor disk; (c) a third rotor disk; and (d) a rotor support plate; said first and second rotor disks defining an inner cylindrical cavity and an outer rotor rim; said first, second, and third rotor disks sharing a common axis of rotation; said first and second rotor disks being rotatably coupled; said third rotor disk being disposed between said first and second rotor disks, said third rotor disk being independently rotatable relative to said first and second rotor disks, said third rotor disk comprising a raised surface structure; said first, second and third rotor disks together with at least two vanes and said rotor support plate defining a radial flow channel encompassing the raised surface structure of the third rotor disk; said radial flow channel comprising a supersonic compression ramp; said radial flow channel allowing fluid communication radially between the inner cylindrical cavity and said outer rotor rim.

In a third aspect, the present invention provides a supersonic compressor rotor comprising (a) a first rotor disk; (b) a second rotor disk; and (c) a third rotor disk; said first, second; and third rotor disks defining an outer surface of the supersonic compressor rotor, said first, second, and third rotor disks sharing a common axis of rotation; said first and second rotor disks being rotatably coupled; said third rotor disk being disposed between said first and second rotor disks, said third rotor disk being independently rotatable relative to said first and second rotor disks, said third rotor disk comprising a raised surface structure; said first, second and third rotor disks together with at least two vanes defining an axial flow channel encompassing the raised surface structure of the third rotor disk; said axial flow channel comprising a supersonic compression ramp; said axial flow channel allowing fluid communication axially along the outer surface the supersonic compressor rotor.

In a fourth aspect, the present invention provides a supersonic compressor comprising (a) a fluid inlet; (b) a fluid outlet; and (c) at least one supersonic compressor rotor, said supersonic compressor rotor comprising: (i) a first rotor disk; (ii) a second rotor disk; and (iii) a third rotor disk; said first, second, and third rotor disks sharing a common axis of rotation; said first and second rotor disks being rotatably coupled; said third rotor disk being disposed between said first and second rotor disks, said third rotor disk being independently rotatable relative to said first and second rotor disks, said third rotor disk comprising a raised surface structure; said first, second and third rotor disks together with at least two vanes defining a flow channel encompassing the raised surface structure of the third rotor disk; said flow channel comprising a supersonic compression ramp.

In a fifth aspect, the present invention provides a method of compressing a fluid comprising (a) introducing a fluid through a low pressure gas inlet into a gas conduit comprised within a supersonic compressor; and (b) removing a gas through a high pressure gas outlet of said supersonic compressor; said supersonic compressor comprising a supersonic compressor rotor disposed between said gas inlet and said gas outlet, said supersonic compressor rotor comprising: (i) a first rotor disk; (ii) a second rotor disk; and (iii) a third rotor disk; said first, second, and third rotor disks sharing a common axis of rotation; said first and second rotor disks being rotatably coupled; said third rotor disk being disposed between said first and second rotor disks, said third rotor disk being independently rotatable relative to said first and second rotor disks, said third rotor disk comprising a raised surface structure; said first, second and third rotor disks together with at least two vanes defining a flow channel encompassing the raised surface structure of the third rotor disk; said flow channel comprising a supersonic compression ramp.

In a sixth aspect, the present invention provides a method for starting a supersonic compressor, said method comprising: (a) providing a supersonic compressor comprising a supersonic compressor rotor disposed within a fluid conduit of the supersonic compressor; said supersonic compressor rotor comprising: (i) a first rotor disk; (ii) a second rotor disk; and (iii) a third rotor disk; said first, second, and third rotor disks sharing a common axis of rotation; said first and second rotor disks being rotatably coupled; said third rotor disk being disposed between said first and second rotor disks, said third rotor disk being independently rotatable relative to said first and second rotor disks, said third rotor disk comprising a raised surface structure; said first, second and third rotor disks together with at least two vanes defining a flow channel encompassing the raised surface structure of the third rotor disk; said flow channel comprising a supersonic compression ramp; (b) positioning the raised surface structure of the third rotor disk within the flow channel such that a throat area of the flow channel is relatively less constricted as the supersonic compressor rotor is rotated at subsonic speeds; and (c) repositioning the raised surface structure of the third rotor disk within the flow channel such that a throat area of the flow channel is relatively more constricted as the supersonic compressor rotor is rotated at supersonic speeds.

BRIEF DESCRIPTION OF THE DRAWING FIGURES

These and other features, aspects, and advantages of the present invention will become better understood when the following detailed description is read with reference to the accompanying drawings in which like characters represent like parts throughout the drawings, wherein.

Figure 1:
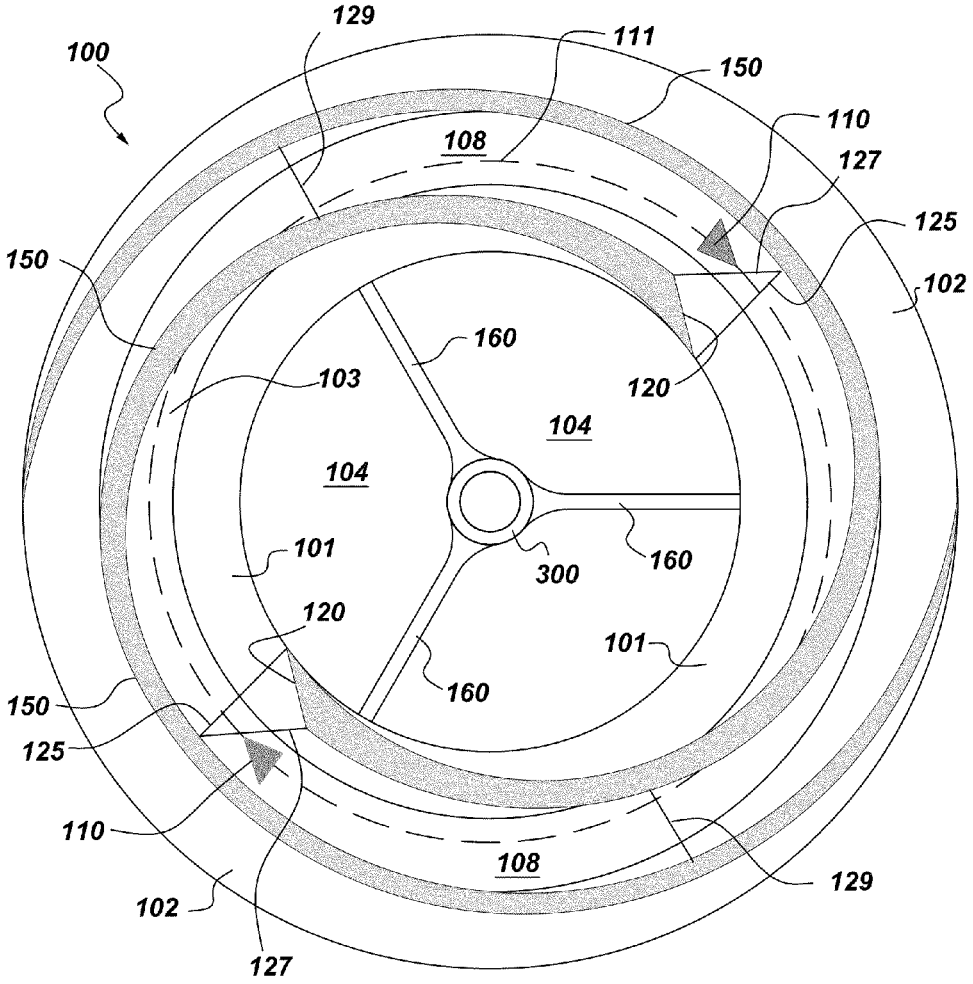
FIG. 1 illustrates a radial supersonic compressor rotor provided by the present invention.

In the drawings provided herein, like characters represent like parts. Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "supersonic compressor rotor" refers to a compressor rotor comprising a supersonic compression ramp disposed within a fluid flow channel of the supersonic compressor rotor, the supersonic compressor rotor being configured such that during operation the speed of a fluid encountering a fluid inlet of the fluid flow channel of the moving rotor is supersonic.

As used herein, the term "supersonic compressor" refers to a compressor comprising a supersonic compressor rotor.

Known supersonic compressors, which may comprise one or more supersonic compressor rotors, are configured to compress a fluid between the outer rim of the supersonic compressor rotor and the inner wall of the fluid conduit in which the supersonic compressor rotor is disposed. In such supersonic compressors, fluid is transported across the outer rotor rim of the supersonic compressor rotor from the low pressure side of the fluid conduit to the high pressure side of the fluid conduit. Vanes (at times referred to as strakes) arrayed on the outer rotor rim provide an axial flow channel through which fluid moves from one side of the supersonic compressor rotor to the other. Supersonic compressors comprising supersonic compressor rotors are described in detail in, for example, U.S. Pat. Nos. 7,334,990 and 7,293,955 filed Mar. 28, 2005 and Mar. 23, 2005 respectively, and U.S. Patent Application 2009/0196731 filed Jan. 16, 2009.

The present invention features novel supersonic compressor rotors in which fluid transport from the low pressure side of the fluid conduit to the high pressure side of the fluid conduit occurs via either a radial flow channel or an axial flow channel and thus includes supersonic compressor rotors which possess radial flow characteristics or axial flow characteristics. Supersonic compressor rotors provided by the present invention possessing radial flow characteristics comprise a radial flow channel linking an inner cylindrical cavity of the supersonic compressor rotor to the outer rotor rim. Supersonic compressor rotors provided by the present invention possessing axial flow characteristics comprise an axial flow channel linking a first side or face of the supersonic compressor rotor to a second side or face of the supersonic compressor rotor. Regardless of whether the supersonic compressor rotor provided by the present invention possesses radial flow characteristics or axial flow characteristics, each of the supersonic compressor rotors provided by the present invention comprises a "clockable" third rotor disk comprising a raised surface structure which may be used to expand or restrict the free volume within a given portion of the fluid flow channel. By "clockable" it is meant that the third rotor disk is independently rotatable relative to a first rotor disk and a second rotor disk which are components of the supersonic compressor rotor. This allows a limited range of motion of the raised surface structure within the fluid flow channel in order to expand or restrict the free volume of a given portion of the fluid flow channel. The novel design features of the supersonic compressor rotors provided by the present invention are expected to enhance performance of supersonic compressors comprising them, and to provide for greater design versatility in systems comprising such novel supersonic compressors. In various embodiments, the novel supersonic compressor rotors possessing radial flow characteristics provided by the present invention can be configured for inside-out compression or outside-in compression. A supersonic compressor rotor possessing radial flow characteristics is configured for inside-out compression when during operation as the rotor spins fluid moves from the inner cylindrical cavity through the radial flow channel to the outer rotor rim. The supersonic compressor rotor is configured for outside-in compression when during operation as the rotor spins fluid moves from the outer rotor rim through the radial flow channel to the inner cylindrical cavity. Whether or not a supersonic compressor rotor possessing radial flow characteristics is configured for inside-out or outside compression may be determined by the location of the supersonic compression ramp within the radial flow channel and the configuration of the vanes at the fluid inlet of the radial flow channel, or simply by the direction in which the supersonic compressor rotor is rotated. In the various examples illustrated in the figures herein, the supersonic compressor rotors possessing radial flow characteristics are shown as configured for inside-out compression.

As noted, in one embodiment, the present invention provides a supersonic compressor rotor comprising a first rotor disk, a second rotor disk, and a third rotor disk, which disks share a common axis of rotation. The disks are arranged such that the third rotor disk is disposed between the first rotor disk and the second rotor disk. The first rotor disk and the second rotor disk are rotatably coupled to one another, for example by a common drive shaft (See FIG. 7) or by one or more vanes, such that when the first rotor disk is attached to a drive shaft and the drive shaft is set in motion, both the first rotor disk and the second rotor disk rotate as a single body. The vanes coupling the first rotor disk and the second rotor disk are disposed on the surface of the disks and define a fluid flow channel. In the case of supersonic compressor rotors configured for radial fluid flow, the vanes may be configured as a spiral across the surface created by the first rotor disk and the second rotor disk (See FIG. 1). In the case of supersonic compressor rotors configured for axial fluid flow, the vanes may be configured in a screw-like fashion across the surface created by the first rotor disk and the second rotor disk (See FIG. 6).

The third rotor disk is disposed between the first and second rotor disks and is typically not in contact with the vanes. In various embodiments it is desirable that the clearance between the third rotor disk and the vanes be as small as possible. The clearance between the third rotor disk and the vanes need not be identical or constant, but are typically on the order of a fraction of a millimeter to a few millimeters. In one embodiment, the clearance between the third rotor disk and the vanes is in a range from about 0.01 millimeters to about 1 millimeter.

The third rotor disk comprises at least one raised surface structure. This raised surface structure has dimensions such that the height of the raised surface structure is greater than the clearance between the third rotor disk surface and the vanes. As such, the third rotor disk must be configured such that when the first and second rotor disks co-rotate, the third rotor disk must also rotate and, in general, co-rotate with the first rotor disk and the second rotor disk. This can be achieved by allowing contact between the surfaces of the third rotor disk with one of the surfaces of the first rotor disk and one of the surfaces of the second rotor disk. This friction coupling between the disks allows all three disks to co-rotate when, for example, the first rotor disk is coupled to a rotating drive shaft. Because the vanes traverse the surface of the third rotor disk without contacting it, and because the dimensions of the raised surface structure are such that the raised surface structure may not pass under a vane, the raised surface structure is confined to a space between two vanes; the vanes, and the surface of the disks defining a flow channel.

Although the third rotor disk co-rotates with the first and second rotor disks, the third rotor disk is independently rotatable such that the position of the raised surface structure may be varied within the boundaries established by the vanes. In certain embodiments, this variation in the position of the raised surface structure within the boundaries defined by the vanes can be viewed as potential locations of the raised surface structure (See for example element 111 of FIG. 1.). A variety of schemes may be employed to rotate independently or "clock" the third rotor disk relative to the first and second rotor disks. In one scheme, an additional force (beyond that force causing the third rotor disk to co-rotate with the first and second rotor disks) is independently applied to the third rotor disk in order to momentarily decrease or increase its rate of rotation relative to the co-rotating first and second rotor disks. In an alternate scheme, the force applied to the third rotor disk by one or both of the first rotor disk and the second rotor disk is momentarily decreased, thereby causing the third rotor disk to change rotational speed relative to the rate of co-rotation of the first rotor disk and the second rotor disk. Those of ordinary skill in the art will appreciate that during operation, a supersonic compressor rotor is typically operated at very high rotational speeds, for example 10,000 rpm. Thus, the momentary increase or decrease in the rate of rotation of the third rotor disk relative to the first and second rotor disks will be of very short duration (e.g. fractions of seconds).

Thus, the position of the raised surface structure within the flow channel may be varied. This permits the positioning of the raised surface structure in one or more first portions of the flow channel during start up of the supersonic compressor rotor, and positioning of the raised surface structure at one or more second positions during, for example, steady state operation of the supersonic compressor rotor. It is believed that during start up, the fluid inlet (See for example FIG. 2, element 10) of the supersonic compressor rotor should be less, rather than more constricted, and that during steady state operation of the supersonic compressor rotor performance advantages can be achieved by constricting the fluid inlet. Clocking of the third rotor disk allows the raised surface structure to be removed from or introduced into the portion of the flow channel nearest the fluid inlet in order to "open" or constrict the fluid inlet.

As noted, the vanes and the surfaces of the first rotor disk, the second rotor disk, and the third rotor disk define a flow channel of the supersonic compressor rotor. As will be appreciated by those of ordinary skill in the art, in order to be useful the flow channel must be bounded by at least one additional surface. In certain embodiments, the at least one additional surface is integral to the supersonic compressor rotor itself. For example in the embodiment shown in FIG. 3 the supersonic compressor rotor comprises a rotor support plate (See element 105) which supplies this at least one additional surface. In an alternate embodiment, the at least one additional surface is not integral to the supersonic compressor rotor, as in for example, a supersonic compressor rotor of the type illustrated in FIG. 6 wherein when the supersonic compressor rotor is disposed within a supersonic compressor, the at least one additional surface is provided by an inner surface of a fluid conduit within which the supersonic compressor rotor is disposed.

The fluid flow channel is said to comprise at least one supersonic compression ramp which, during operation, provides for the creation of a shock wave within the fluid flow channel. This supersonic compression ramp may be located on any of the structures defining the fluid flow channel. Thus, the supersonic compression ramp may be located on one or more of the vanes, on a disk surface, or on at least one additional surface discussed above. FIGS. 1, 2, 3, 5, 6 and 7 illustrate some of the possible locations of the supersonic compression ramp within the fluid flow channel.

As noted, the supersonic compressor rotor provided by the present invention may be configured for radial compression, for example as in the embodiment shown in FIGS. 1, 2, 3 and 4. In such configurations the fluid flow channels are referred to as radial flow channels. Alternately, the supersonic compressor rotor provided by the present invention may be configured for axial compression, for example as in the embodiments shown in FIGS. 5, 6 and 7. In such configurations the fluid flow channels are referred to as axial flow channels. In a typical embodiment, the number of fluid flow channels is determined by the number of vanes and is equal to the number of vanes. Thus, in the embodiment shown in FIG. 1 the supersonic compressor rotor comprises two vanes and two radial flow channels. In the embodiment shown in FIG. 3 the supersonic compressor rotor comprises six vanes and six radial flow channels. In the embodiments shown in FIG. 5, FIG. 6 and FIG. 7 the supersonic compressor rotor comprises two vanes and two axial flow channels.

In one embodiment, the present invention provides a supersonic compressor rotor comprising at least three axial flow channels. In an alternate embodiment, the present invention provides a supersonic compressor rotor comprising at least three radial flow channels.

The raised surface structure may have a wide variety of shapes and sizes. For example, the raised surface structure may be a wedge, a ramp, a raised diamond, a raised polygon (e.g. a raised pentagon, a raised hexagon or a raised heptagon), a cone, a half cone, a half ellipsoid, a fractional portion of an ellipsoid which is not a half ellipsoid, a pyramid, a cylinder, a half cylinder, a fractional portion of a cylinder which is not a half cylinder, a half sphere, a fractional portion of a sphere which is not a half sphere, or some combination thereof. In addition to the well known geometric shapes discussed above, the raised surface structure may, in certain embodiments, have an irregular shape. In one embodiment, the raised surface structure is a wedge-shaped structure. In an alternate embodiment, the raised surface structure is a ramp-shaped structure. Because the raised surface structure is positioned on the outer surface of the third rotor disk, the portion of the raised surface structure in contact with the third rotor disk will conform to the contour of the third rotor disk. As such, the portion of the raised surface structure in contact with the third rotor disk in a supersonic compressor rotor possessing axial flow characteristics (See FIGS. 5-7) is not, strictly speaking, a truly horizontal surface (with respect to a real or hypothetical reference plane) but for convenience, it will be described as a horizontal surface. Thus, even in embodiments where the raised surface structure is a well known geometric shape, such as a wedge or a half sphere, its shape will be slightly irregular (i.e. deviate from the geometric ideal) when that portion of the raised surface structure in contact with the third rotor disk conforms to the surface contour of the disk and a counterpart surface of the raised surface structure does not (e.g. a wedge-shaped raised surface structure in which a first horizontal surface conforms to the contour of the third rotor disk and a second horizontal surface does not).

In order that the meaning of the term raised surface structure might be better understood certain structures constituting potential raised surface structures are described here in greater detail. A raised surface structure which is a wedge is defined herein as a five sided structure having an two horizontal surfaces (typically an upper and a lower surface) of equal dimensions, two vertical surfaces having equal dimensions, and a third vertical surface. A raised surface structure which is a ramp is defined herein, like a wedge, as a five sided structure but having only one horizontal surface, three vertical surfaces, and one surface which is neither horizontal nor vertical. A raised diamond is defined as a six sided structure having two diamond-shaped horizontal surfaces and four vertical surfaces. Similarly, a raised hexagon is defined as an eight sided structure having two hexagon-shaped horizontal surfaces and six vertical surfaces.

The raised surface structure typically has dimensions such that it is no wider than the width of the third rotor disk and is no taller than the vanes defining the flow channel in which the raised surface structure is disposed. Typically, the raised surface structure is a solid structure having a displacement volume which represents from about 0.1 percent to about 25 percent of the volume of the volume of the fluid flow channel in which the raised surface structure is disposed. The volume of the fluid flow channel is defined as the surface area of the rotor disks between the vanes defining the fluid flow channel multiplied by the maximum height of the vanes defining the fluid flow channel. In one embodiment, the raised surface structure is a solid structure having a displacement volume which represents from about 1 percent to about 15 percent of the volume of the volume of the fluid flow channel in which the raised surface structure resides. In an alternate embodiment, the raised surface structure is a solid structure having a displacement volume which represents from about 5 percent to about 10 percent of the volume of the volume of the fluid flow channel in which the raised surface structure resides.

The supersonic compressor rotors provided by the present invention are useful as components of supersonic compressors. Thus, in one aspect the present invention provides a supersonic compressor comprising a supersonic compressor rotor of the present invention. The supersonic compressors provided by the present invention may comprise one or more additional features such as a conventional centrifugal compressor rotor (See for example FIG. 4). In certain embodiments, the supersonic compressor provided by the present invention may comprise a plurality of supersonic compressor rotors of the invention. Thus, in one embodiment, the present invention provides a supersonic compressor comprising at least two supersonic compressor rotors of the invention.

Supersonic compressors provided by the present invention may be used in a variety of applications. Thus, in one embodiment, the present invention provides a gas turbine comprising a supersonic compressor of the present invention.

In one aspect, the present invention provides a method of compressing a fluid. The fluid may be any fluid susceptible of supersonic compression, for example carbon dioxide, natural gas, or a mixture comprising carbon dioxide, natural gas. Other suitable fluids which may be compressed according to the method provided by the present invention include halocarbons, low molecular weight alkanes such as methane and ethylene, and natural gas mixtures comprising natural gas, carbon dioxide, water vapor and hydrogen sulfide. Thus, according to one embodiment, a process fluid, for example a methane-$CO_2$ mixture, is introduced through a low pressure gas inlet into a gas conduit of a supersonic compressor and fed to the inlet side (low pressure side) of a rotating supersonic compressor rotor of the present invention rotating at high speed, for example 10,000 rpm. A portion of the process fluid encountering the low pressure side of supersonic compressor rotor passes into the flow channel of the supersonic compressor rotor where the fluid is compressed. A portion of the compressed fluid exits the supersonic compressor rotor on the high pressure side of the rotor and is removed from the supersonic compressor via a high pressure gas outlet.

In one embodiment, the method of the present invention employs a supersonic compressor rotor comprising two or more fluid flow channels. In an alternate embodiment, the method of the present invention employs a supersonic compressor rotor comprising at least three fluid flow channels. In one embodiment, the fluid flow channels are radial flow channels. In an alternate embodiment, the fluid flow channels are axial flow channels.

In one embodiment, the method of the present invention employs a supersonic compressor comprising a plurality of supersonic compressor rotors, for example two counter-rotating supersonic compressor rotors of the invention arrayed in series within a fluid conduit of the supersonic compressor. In one embodiment, the method of the present invention employs a supersonic compressor comprising at least one conventional centrifugal compressor rotor in addition to at least one supersonic compressor rotor of the invention.

Referring now to FIG. 1, the figure illustrates a supersonic compressor rotor 100 of the present invention, the rotor comprising a first rotor disk 101, a second rotor disk 102 and a third rotor disk 103. The rotor disks 101-103 share a common axis of rotation. First rotor disk 101 and second rotor disk 102 are rotatably coupled by the two vanes 150. The third rotor disk 103 is disposed between the first rotor disk and the second rotor disk and is independently rotatable relative to the first and second rotor disks. Third rotor disk 103 comprises on its surface a raised surface structure 110 which may be clocked relative to first rotor disk 101 and second rotor disk 102 along a series of potential locations shown as dashed line 111 and between vanes 150. First rotor disk 101 is coupled to drive shaft 300 via rotor support struts 160 which transfer mechanical energy from the drive shaft to first rotor disk 101 which is in turn rotatably coupled to second rotor disk 102 via vanes 150. Rotor disks 101-103 and vanes 150 together define a radial flow channel 108 which comprises supersonic compression ramp 120 and provides fluid communication between inner cylindrical cavity 104 and outer edge (outer rotor rim, See element 112 of FIG. 4) of the supersonic compressor rotor. During operation, fluid entering radial flow channel 108 from inner cylindrical cavity 104 encounters supersonic compression ramp 120 at supersonic speed setting up an oblique shock wave 125 which is reflected back from the adjacent vane surface thereby forming reflected oblique shock wave 127 and normal shock wave 109. The raised surface structures 110 may be positioned anywhere along path 111 and between the vanes 150.

Figure 2:
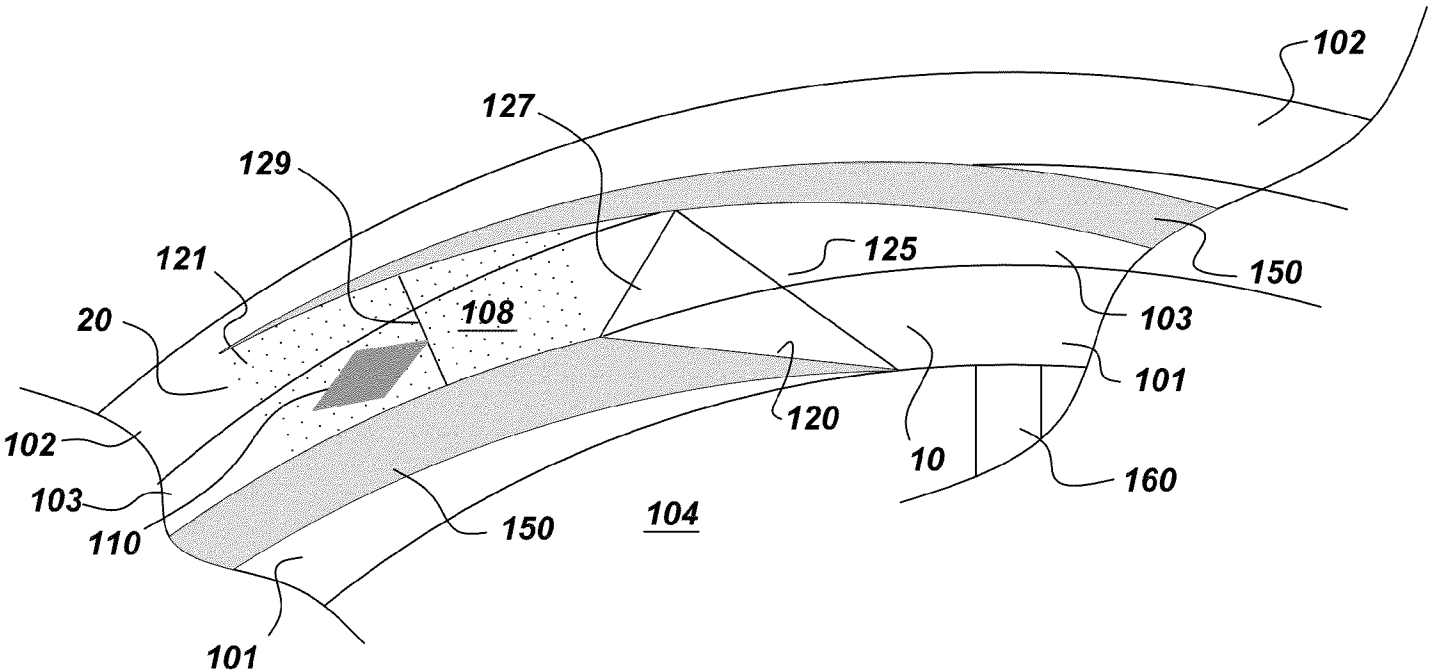
FIG. 2 illustrates an inset view of a radial supersonic compressor rotor provided by the present invention.

Referring now to FIG. 2, the figure illustrates an enlarged portion of supersonic compressor rotor 100 of the present invention. Raised surface structure 110 is shown as a diamond shaped raised structure ("raised diamond") attached to the surface of third rotor disk 103. Raised surface structure 110 is shown in this embodiment as located between vanes 150 nearer the fluid outlet 20 than the fluid inlet 10. FIG. 2 shows the supersonic compressor rotor in operation at supersonic speeds and indicates the location of the supersonic compression ramp 120, the oblique shock wave 125 formed as fluid entering radial flow channel 108 encounters the supersonic compression ramp. FIG. 2 also indicates the presence of reflected shock wave 127, normal shock wave 129 and a subsonic diffusion zone 121.

Figure 3:
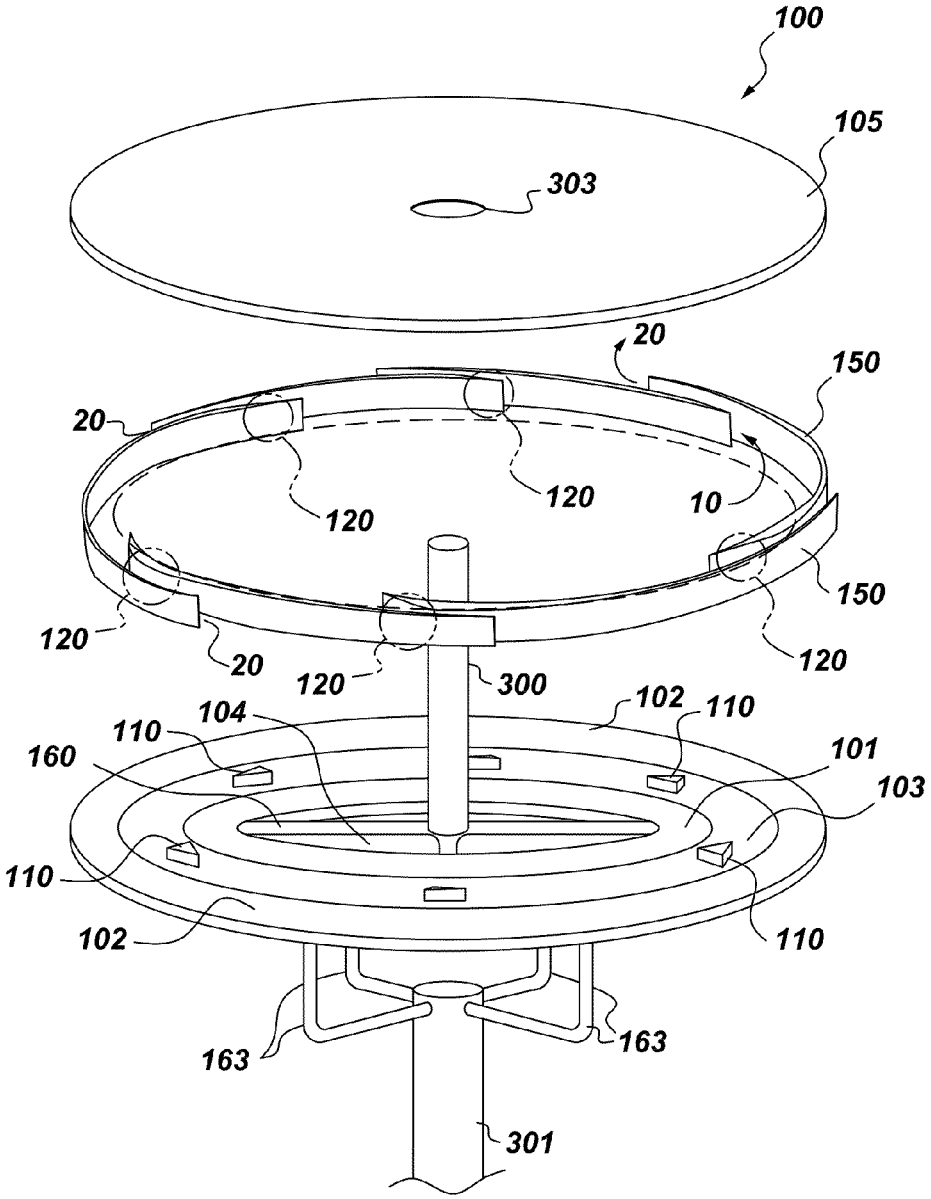
FIG. 3 illustrates an exploded view of a radial supersonic compressor rotor provided by the present invention.

Referring now to FIG. 3, the figure shows an exploded view of an illustrative supersonic compressor rotor 100 of the present invention. The figure shows third rotor disk 103 disposed between first rotor disk 101 and second rotor disk 102. A set of six vanes 150 rotatably couple first rotor disk 101 to second rotor disk 102. Rotor disks 101-103 and vanes 150 together define a set of six radial flow channels 108 (See FIGS. 1 and 2) which define a fluid inlet 10 and a fluid outlet 20. In FIG. 3 each vane comprises a single supersonic compression ramp 120 and the vanes are arranged such that the supersonic compression ramp 120 is within radial flow channel 108 adjacent to fluid inlet 10. On the surface of third rotor disk 103 are disposed at regular intervals a set of six raised surface structures 110 which are comprised within each of the radial flow channels 108 respectively. Rotor support plate 105 is affixed to vanes 150 and further defines radial flow channels 108. The rotor as a whole may be rotated to supersonic speed by rotating drive shaft 300 which is mechanically coupled to first rotor disk 101 via rotor support struts 160. Drive shaft 300 passes through rotor support plate 105 via aperture 303. Third rotor disk 103 is independently rotatable via drive shaft 301 which is connected to third rotor disk 103 via rotor support struts 163. In the embodiment shown, drive shaft 301 is not directly coupled to either of the first or second rotor disks. By applying force to drive shaft 301 the positions of raised surface structures 110 within each of the radial flow channels may be varied to restrict or open a given portion of the radial flow channel 108.

Figure 4:
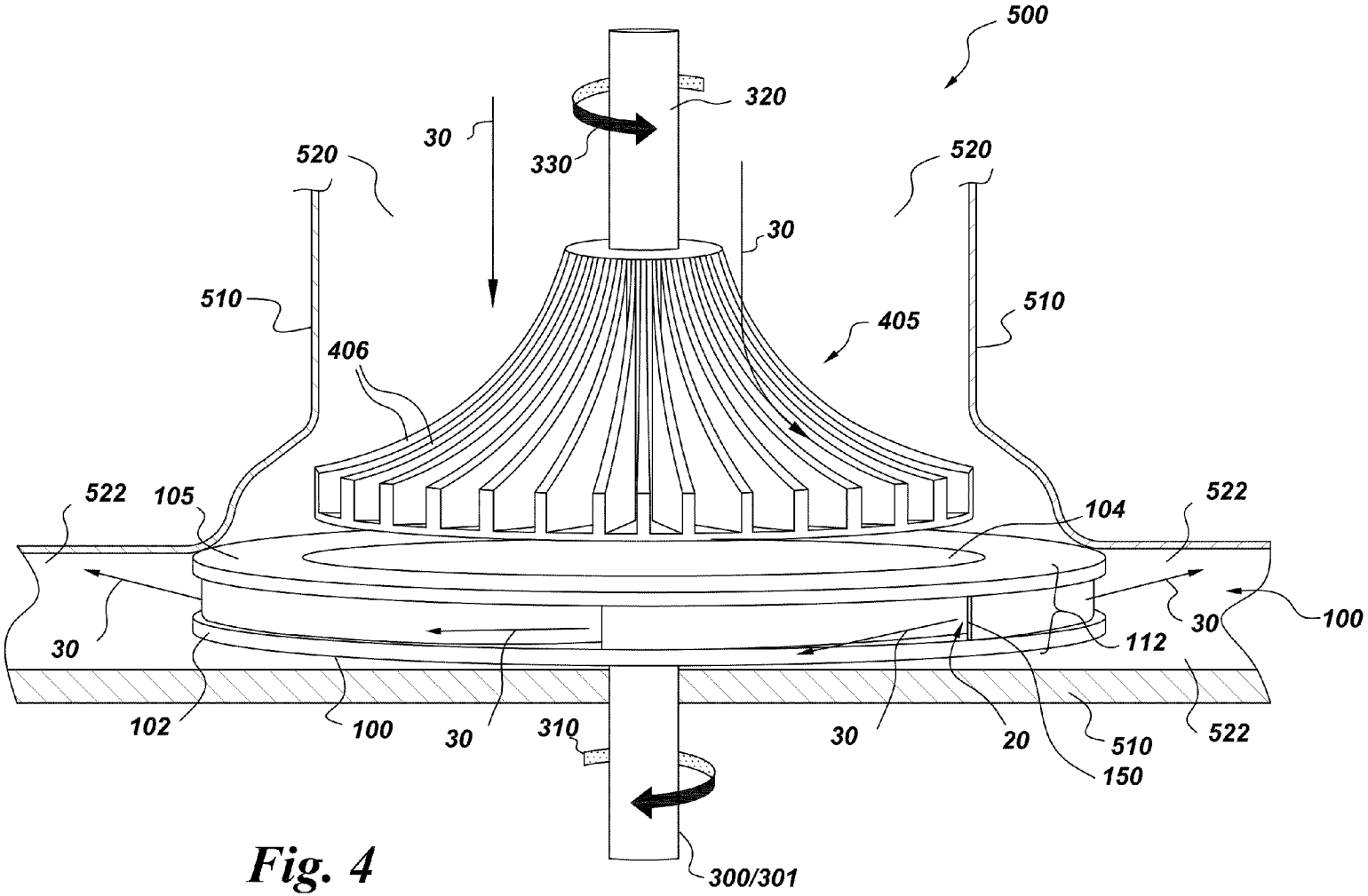
FIG. 4 illustrates a supersonic compressor provided by the present invention.

Referring to FIG. 4, the figure illustrates an embodiment of the present invention and some basic attributes of its operation. The figure illustrates a supersonic compressor 500 shown in an exploded view comprising a supersonic compressor rotor 100 of the present invention and a conventional centrifugal compressor rotor 405 housed within compressor housing 510. The supersonic compressor rotor 100 and conventional centrifugal compressor rotor 405 are said to be disposed within a fluid conduit of the supersonic compressor, the fluid conduit being defined at least in part by the compressor housing, the fluid conduit comprising a low pressure side 520 and a high pressure side 522, referred to as the low pressure side of the fluid conduit 520 and the high pressure side of the fluid conduit 522, respectively. The view shown in FIG. 4 is "exploded" in the sense that the conventional centrifugal compressor rotor 405 is shown as separated from and above the inner cylindrical cavity 104 of the supersonic compressor rotor 100. In various embodiments, the conventional centrifugal compressor rotor 405 is actually disposed within the inner cylindrical cavity 104. Supersonic compressor rotor 100 is driven by a combined drive shaft 300/301 in direction 310. The conventional centrifugal compressor rotor 405 is driven by drive shaft 320 in direction 330. As shown the supersonic compressor rotor 100 and conventional centrifugal compressor rotor 405 are configured for counter rotary motion. A fluid (not shown) introduced through a compressor inlet (not shown) enters the low pressure side of the fluid conduit 520 and encounters blades 406 of the conventional centrifugal compressor rotor 405 rotating in direction 330. The direction of fluid flow 30 is changed as the fluid encounters the rotating conventional centrifugal compressor rotor. The fluid is directed radially outward from the conventional centrifugal compressor rotor 405 disposed within inner cylindrical cavity 104 of supersonic compressor rotor 100. Supersonic compressor rotor 100 defines an inner cylindrical cavity 104 and an outer rotor rim 112 and at least two radial flow channels 108 (not shown) allowing fluid communication between the inner cylindrical cavity 104 and the outer rotor rim 112, said radial flow channel comprising a supersonic compression ramp (not shown). In the embodiment shown in FIG. 4 the supersonic compressor rotor 100 comprises a rotor support plate 105 (rotor plate) and three rotor disks (not shown); a first rotor disk, a second rotor disk, and a third rotor disk which together with vanes 150 and rotor support plate 105 define at least two radial flow channels. The rotor support plate 105 defines an aperture through which conventional centrifugal compressor rotor 405 may be inserted into the inner cylindrical cavity 104. In the embodiment shown, the supersonic compressor rotor 100 is mechanically coupled to drive shaft 300/301 which provides for both rotation of the rotor as a whole but also for clocking the third rotor disk 103 (not shown) relative to first rotor disk 101 (not shown) and second rotor disk 102 (not shown). In one embodiment, drive shaft 300/301 is comprises two concentric drive shafts an inner shaft (not shown) of which is mechanically coupled to first rotor disk 101 (not shown) via rotor support struts 160 (not shown) as in for example FIG. 1, and an outer drive shaft which is mechanically coupled to third rotor disk 103 (not shown) via rotor support struts 163 (not shown) as in for example FIG. 3. The radially outward moving fluid encounters the fluid inlet 10 (not shown) of the rotating supersonic compressor rotor 100 and is directed into a radial flow channel 108 (not shown) which compresses the fluid passing from the inner cylindrical cavity 104 to the outer rotor rim 112 of the supersonic compressor rotor. The radial flow channel 108 (not shown) comprises a supersonic compression ramp 120 (not shown) which compresses the fluid within the radial flow channel and directs the compressed fluid toward fluid outlet 20. The fluid exiting fluid outlet 20 then enters the high pressure side of the fluid conduit 522. The compressed fluid within the high pressure side of the fluid conduit 522 may be used to perform work, or be used for some other purpose.

Referring to FIG. 5, the figure illustrates a supersonic compressor rotor 100 of the present invention having axial flow characteristics. The supersonic compressor rotor comprises a first rotor disk 101, a second rotor disk 102 and a third rotor disk 103 disposed between them. The three rotor disks together form an outer surface 117 of the supersonic compressor rotor and share a common axis of rotation 116. First and second rotor disks 101 and 102 are rotatably coupled via vanes two 150 which together with rotor disks 101-103 define two axial flow channels 109, the axial flow channels comprising a fluid inlet 10 and a fluid outlet 20. The third rotor disk 103 is independently rotatable (clockable) relative to the first and second rotor disks, and comprises raised surface structure 110. Vanes 150 comprise a supersonic compression ramp 120 which forms part of axial flow channel.

Figure 5A:
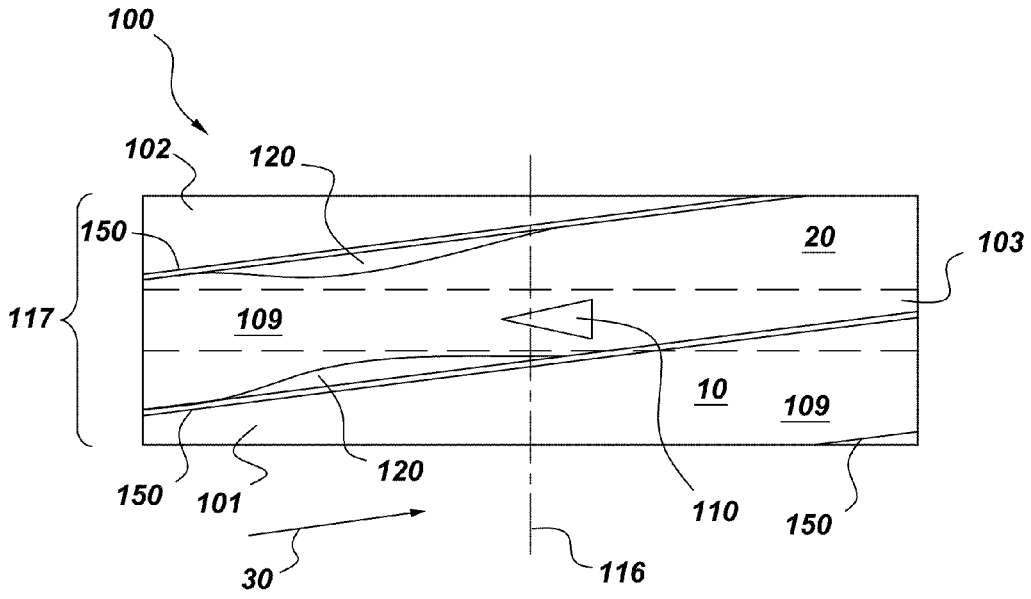
FIGS. 5A-5B illustrate an inset view of an axial supersonic compressor rotor provided by the present invention.

FIG. 5*a* shows the supersonic compressor rotor in operation under conditions in which the raised surface structure is located downstream of a throat area of the axial flow channel, the throat area being defined by supersonic compression ramps 120 opposite one another on the surface of vanes 150. Fluid encounters the rotating supersonic compressor rotor at fluid inlet 10 and is conducted along a spiral path (axial flow channel) across the outer surface of supersonic compressor rotor 117 until it encounters the supersonic compression ramps 120 is compressed and ejected via fluid outlet 20. The configuration shown in FIG. 5*a* is appropriate for use during rotor start up.

Figure 5B:
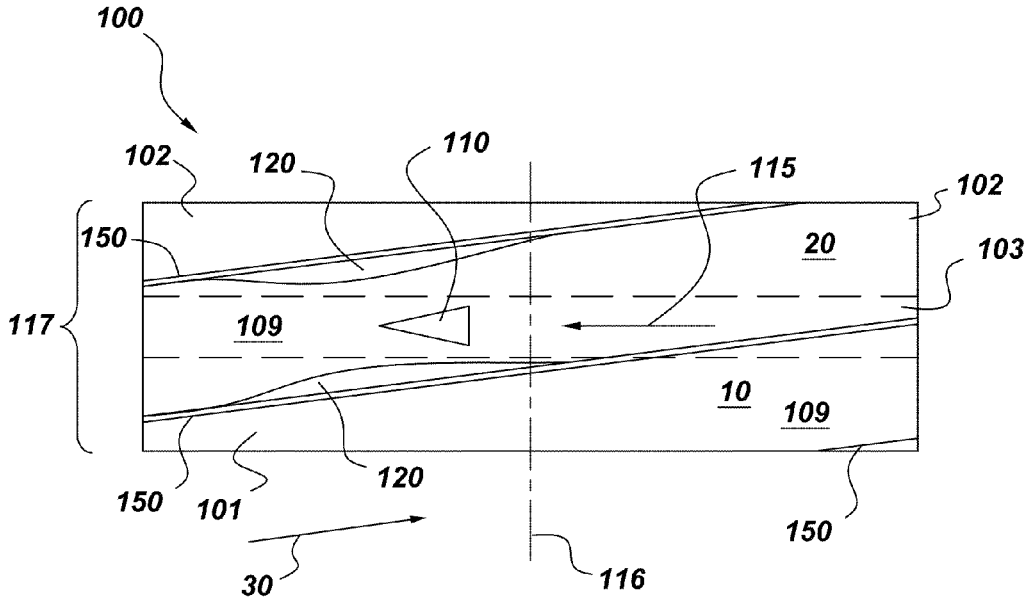

FIG. 5*b* shows the supersonic compressor rotor in operation under conditions in which the raised surface structure is located within the throat area of the axial flow channel. The configuration shown in FIG. 5*b* is appropriate for use during steady state operation of the rotor. The direction of displacement of the raised surface structure relative to its position in FIG. 5*a* is shown as arrow 115 in FIG. 5*b*.

Figure 6:
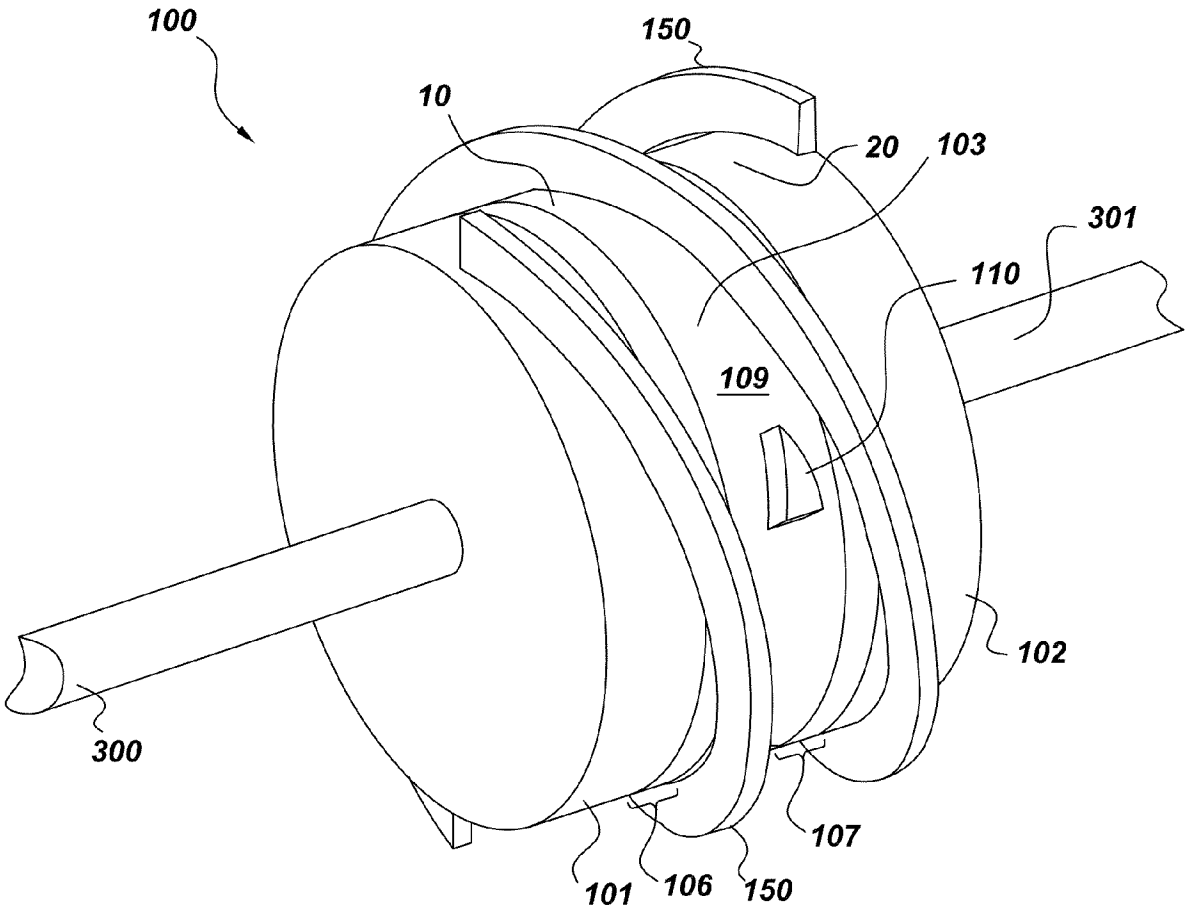
FIG. 6 illustrates an axial supersonic compressor rotor provided by the present invention.

Referring to FIG. 6, the figure further illustrates the supersonic compressor rotor 100 illustrated in FIG. 5 and provides additional details. In the figure, a drive shaft 300 is mechanically coupled to first rotor disk 101 which is rotatably coupled to second rotor disk 102 by the two vanes 150. A drive shaft 301 allows independent rotation of the third rotor disk 103 relative to first and second rotor disks 101 and 102 which allows the position of raised surface structure 110 to be varied within axial flow channel 109. In application, the supersonic compressor rotor 100 shown in FIG. 6 is typically disposed within a supersonic compressor housing (not shown). In FIG. 6 (and FIG. 7), the first rotor disk 101 and the third rotor disk 103 are shown as separated by a gap 106 which is exaggerated and not to scale in order to distinguish first rotor disk 101 from third rotor disk 103. Similarly, the second rotor disk 102 is shown in the figure as separated from third rotor disk 103 by a gap 107. Again this gap is exaggerated and not to scale in order to distinguish second rotor disk 102 from third rotor disk 103 in the figure. As noted, third rotor disk 103 is typically in contact with both of first rotor disk 101 and second rotor disk 102.

Figure 7:
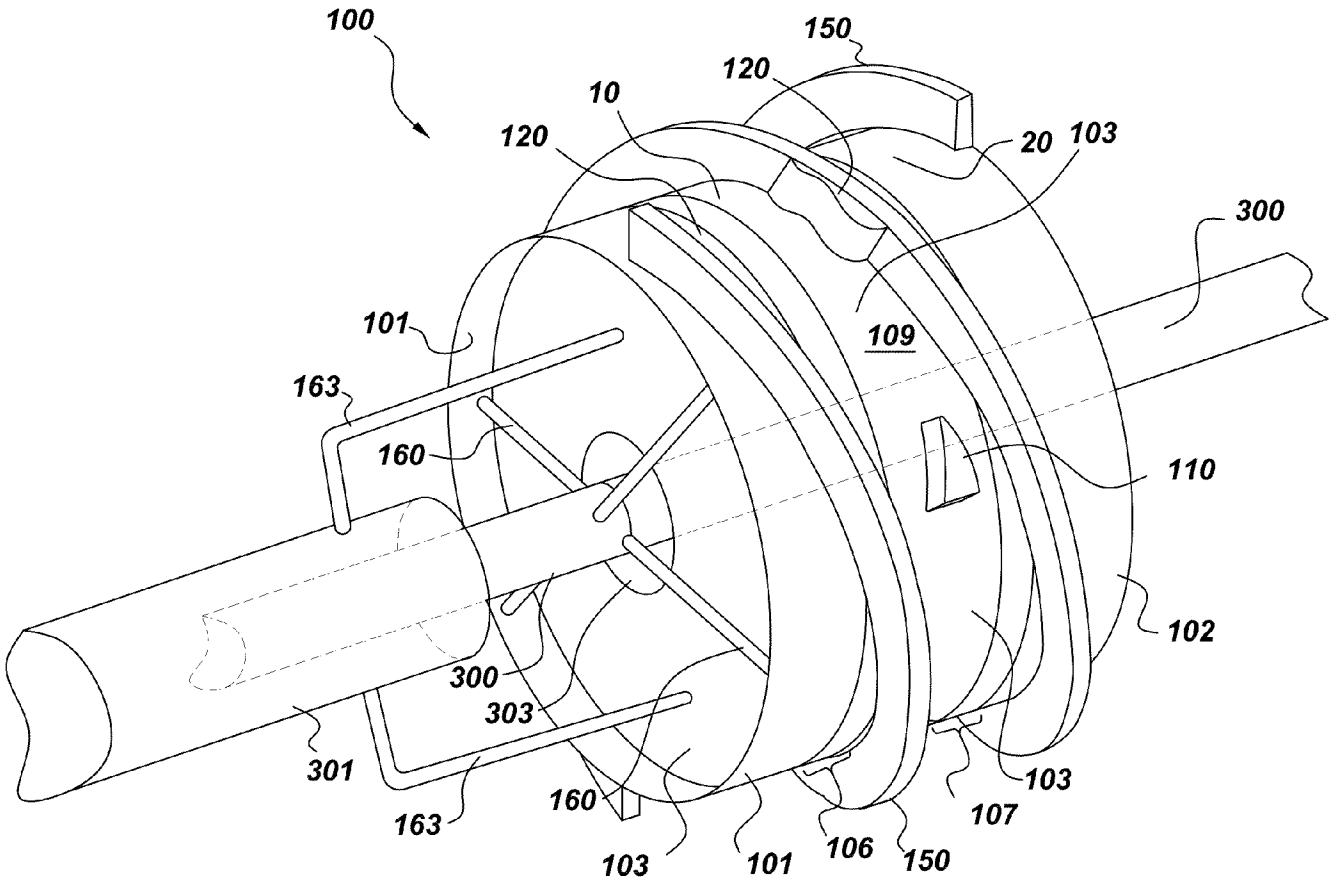
FIG. 7 illustrates an axial supersonic compressor rotor provided by the present invention.

Referring now to FIG. 7, the figure illustrates a supersonic compressor rotor 100 of the present invention which does not rely on vanes 150 to rotatably couple the first rotor disk 101 to the second rotor disk 102. Rather the first and second rotor disks 101 and 102 are rotatably coupled by drive shaft 300 which passes through third rotor disk 103 via aperture 303. Rotor disks 101-103 share a common axis of rotation (indicated by the axis of drive shaft 300 in FIG. 7). Drive shaft 300 is not in direct contact with third rotor disk 103. In the embodiment shown in FIG. 7 the mechanical coupling between first rotor disk 101 and drive shaft 300 is effected by rotor support struts 160. Second rotor disk 102 is directly coupled (coupling not shown) to drive shaft 300. The figure shows third rotor disk 103 disposed between first rotor disk 101 and second rotor disk 102. Rotor disks 101-103 and vanes 150 together define two axial flow channels 109 which define a fluid inlet 10 and a fluid outlet 20. In FIG. 7 each vane comprises at least one supersonic compression ramp 120 and the vanes are arranged such that the supersonic compression ramps 120 are disposed within axial flow channel 109 adjacent to fluid inlet 10. On the exterior surface of third rotor disk 103 are disposed a set of two raised surface structures 110 which are comprised within each of the axial flow channels 109 respectively. The position of raised surface structures 110 may be adjusted by applying a force independently to co-rotating concentric drive shaft 301. Drive shaft 301 is coupled to third rotor disk 103 via rotor support struts 163. The rotor as a whole may be rotated to supersonic speed by co-rotating drive shafts 300 and 301. Third rotor disk 103 is said to be independently rotatable with respect to first rotor disk 101 and second rotor disk 102 via drive shaft 301. In the embodiment shown, drive shaft 301 is not directly coupled to either of the first or second rotor disks. By applying force to drive shaft 301 the positions of raised surface structures 110 within each of the radial flow channels may be varied to restrict or open a given portion of the axial flow channel 109. Those of ordinary skill in the art will appreciate that drive shaft 301 co-rotates with drive shaft 300 to prevent contact between rotor support struts 160 and rotor support struts 163, and that the positions of rotor support struts 163 may be varied within an arc bounded by rotor support struts 160, and this corresponds to potential locations of the raised surface structures 110 within axial flow channels 109. In the supersonic compressor rotor illustrated in FIG. 7, vanes 150 are attached to the surface of first rotor disk 101 but are not attached to second rotor disk 102. Vanes 150 are separated from the surface of the second rotor disk by a gap (not shown) which in embodiments in which the first rotor disk and the second rotor disk are not rotatably coupled by vanes 150 is typically on the order of a fraction of a millimeter to a few millimeters. In one embodiment, the clearance between the second rotor disk and the vanes is in a range from about 0.01 millimeters to about 1 millimeter.

In a further embodiment, the present invention provides a method for starting a supersonic compressor. The method comprises (a) providing a supersonic compressor comprising a supersonic compressor rotor disposed within a fluid conduit of the supersonic compressor, for example a supersonic compressor rotor at rest. The supersonic compressor comprises a supersonic compressor rotor of the invention, for example the supersonic compressor rotor illustrated in FIG. 6. The supersonic compressor rotor comprises (i) a first rotor disk 101; (ii) a second rotor disk 102; and (iii) a third rotor disk 103; and the first, second, and third rotor disks share a common axis of rotation. Typically, the common axis of rotation corresponds to the axis of rotation of one or more drive shafts (See FIG. 6 drive shafts 300 and 301) used to drive the supersonic compressor rotor. The first and second rotor disks are rotatably coupled. This mechanical coupling causes the first rotor disk and the second rotor disk to rotate as a unit and may be effected by means of two or more vanes 150 mounted on the outer surfaces of the first rotor disk and second rotor disk. Alternately, this mechanical coupling of the first rotor disk and the second rotor disk may be made by some other means, for example by having both the first rotor disk and the second rotor disk be attached to a common drive shaft 300 (See for example FIG. 7). In some embodiments the first rotor disk and the second rotor disk are mechanically coupled by a combination of means, for example by a common drive shaft 300 and vanes 150. The third rotor disk is disposed between the first and second rotor disks and is independently rotatable relative to the first and second rotor disks. The third rotor disk comprises a raised surface structure 110 situated on an outer surface of the third rotor disk. This raised surface structure resides within a radial or axial flow channel defined by the first, second and third rotor disks together with at least two vanes. The flow channel comprises a supersonic compression ramp on one or more surfaces defining the flow channel. Using the means for independently rotating the third rotor disk relative to the first rotor disk and the second rotor disk, for example drive shaft 301 coupled to rotor support struts 163 (See FIG. 7), the raised surface structure is positioned within the flow channel such that the throat area of the radial flow channel is relatively less constricted. The throat area of the flow channel is that portion of the flow channel constricted by the supersonic compression ramp 120 and is illustrated by the space between the supersonic compression ramp and a surface of the flow channel opposite the supersonic compression ramp (See for example, FIG. 5 wherein the throat area of the flow channel is shown as the space between opposing supersonic compression ramps 120). At low speeds, for example subsonic speeds, it is advantageous that the throat area of the flow channel be less constricted than at higher speeds. FIG. 5*a* illustrates this positioning of the raised surface structure within the flow channel such that a throat area of the flow channel is relatively less constricted relative to FIG. 5*b* which illustrates the positioning of the raised surface structure 110 within the flow channel 109 such that the throat area is relatively more constricted than in the configuration shown in FIG. 5*a*. Thus, FIG. 5*a* illustrates a desirable positioning of the raised surface structure 110 during start up when the supersonic compressor rotor is being rotated at subsonic speeds, and FIG. 5*b* illustrates a desirable positioning of the raised surface structure 110 during steady state operation when the supersonic compressor rotor is being rotated at supersonic speeds. As the speed of the supersonic compressor rotor transitions from a subsonic regime to a supersonic regime, the raised surface structure may be repositioned from a first position within the flow channel to a second position within the flow channel by the application of a force to the third rotor disk via, for example, drive shaft 301 and rotor support struts 163. Those of ordinary skill in the art will appreciate that the throat area of the flow channel is relatively more constricted in the configuration shown in FIG. 5*b* than it is in the configuration shown in FIG. 5*a*. This ability to open up the throat area of the supersonic compressor rotor at lower speeds and constrict the throat area of the supersonic compressor rotor at higher speeds enables a unique and efficient means of starting a supersonic compressor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A supersonic compressor rotor comprising:

(a) a first rotor disk;

(b) a second rotor disk; and (c) a third rotor disk;

said first, second, and third rotor disks sharing a common axis of rotation;

said first and second rotor disks being rotatably coupled and together defining a rotor surface of the supersonic compressor rotor;

said third rotor disk being disposed between said first and second rotor disks, said third rotor disk being independently rotatable relative to said first and second rotor disks, said third rotor disk comprising a raised surface structure;

said first, second and third rotor disks together with at least two vanes defining a flow channel encompassing the raised surface structure of the third rotor disk;

said flow channel comprising a supersonic compression ramp;

wherein the at least two vanes are disposed in a screw-like fashion across the rotor surface defined by the first and second rotor disks and rotatably couple the first and second rotor disks, and wherein the raised surface structure is of dimensions such that it may not pass under a vane.

2. The supersonic compressor rotor according to claim 1, wherein said flow channel is an axial flow channel.

3. The supersonic compressor rotor according to claim 1, wherein the first rotor disk and the second rotor disk are rotatably coupled via a drive shaft.

4. The supersonic compressor rotor according to claim 1, wherein the raised surface structure is a ramp.

5. The supersonic compressor rotor according to claim 1, wherein said flow channel comprises a plurality of supersonic compression ramps.

6. The supersonic compressor rotor according to claim 1, wherein said flow channel defines a subsonic diffusion zone.

7. A supersonic compressor rotor comprising:

(a) a first rotor disk having an outer surface;

(b) a second rotor disk having an outer surface; and (c) a third rotor disk;

said first, second, and third rotor disks defining an outer surface of the supersonic compressor rotor;

said first, second, and third rotor disks sharing a common axis of rotation;

said first and second rotor disks being rotatably coupled;

said third rotor disk being disposed between said first and second rotor disks, said third rotor disk being independently rotatable relative to said first and second rotor disks, said third rotor disk comprising a raised surface structure;

said first, second and third rotor disks together with at least two vanes defining an axial flow channel encompassing the raised surface structure of the third rotor disk;

said axial flow channel comprising a supersonic compression ramp;

said axial flow channel allowing fluid communication axially along the outer surface the supersonic compressor rotor;

wherein the at least two vanes are disposed in a screw-like fashion across and joined to the outer surfaces of the first and second rotor disks;

and wherein the raised surface structure is of dimensions such that it may not pass under a vane.

8. A supersonic compressor comprising:

(a) a fluid inlet;

(b) a fluid outlet; and (c) at least one supersonic compressor rotor, said supersonic compressor rotor comprising:

(i) a first rotor disk;

(ii) a second rotor disk; and (iii) a third rotor disk;

said first, second, and third rotor disks sharing a common axis of rotation;

said first and second rotor disks being rotatably coupled and together defining a rotor surface of the supersonic compressor rotor;

said third rotor disk being disposed between said first and second rotor disks, said third rotor disk being independently rotatable relative to said first and second rotor disks, said third rotor disk comprising a raised surface structure;

said first, second and third rotor disks together with at least two vanes defining a flow channel encompassing the raised surface structure of the third rotor disk;

said flow channel comprising a supersonic compression ramp;

wherein the at least two vanes are disposed in a screw-like fashion across the rotor surface defined by the first and second rotor disks and rotatably couple the first and second rotor disks, and wherein the raised surface structure is of dimensions such that it may not pass under a vane.

9. The supersonic compressor according to claim 8, which is comprised within a gas turbine.

10. A method of compressing a fluid, said method comprising:

(a) introducing a fluid through a low pressure gas inlet into a gas conduit comprised within a supersonic compressor; and (b) removing a gas through a high pressure gas outlet of said supersonic compressor;

said supersonic compressor comprising a supersonic compressor rotor disposed between said low pressure gas inlet and said high pressure gas outlet, said supersonic compressor rotor comprising:

(i) a first rotor disk;

(ii) a second rotor disk; and (iii) a third rotor disk;

said first, second, and third rotor disks sharing a common axis of rotation;

said first and second rotor disks being rotatably coupled and together defining a rotor surface of the supersonic compressor rotor;

said third rotor disk being disposed between said first and second rotor disks, said third rotor disk being independently rotatable relative to said first and second rotor disks, said third rotor disk comprising a raised surface structure;

said first, second and third rotor disks together with at least two vanes defining a flow channel encompassing the raised surface structure of the third rotor disk;

said flow channel comprising a supersonic compression ramp;

wherein the at least two vanes are disposed in a screw-like fashion across the rotor surface defined by the first and second rotor disks and rotatably couple the first and second rotor disks, and wherein the raised surface structure is of dimensions such that it may not pass under a vane.

11. The method according to claim 10, wherein said fluid comprises carbon dioxide.

12. The method according to claim 10, wherein said fluid comprises natural gas.

13. The method according to claim 10, wherein said supersonic compressor rotor comprises at least three flow channels.

14. A method for starting a supersonic compressor, said method comprising:

(a) providing a supersonic compressor comprising a supersonic compressor rotor disposed within a fluid conduit of the supersonic compressor;

said supersonic compressor rotor comprising:

(i) a first rotor disk;

(ii) a second rotor disk; and (iii) a third rotor disk;

said first, second, and third rotor disks sharing a common axis of rotation;

said first and second rotor disks being rotatably coupled and together defining a rotor surface of the supersonic compressor rotor;

said third rotor disk being disposed between said first and second rotor disks, said third rotor disk being independently rotatable relative to said first and second rotor disks, said third rotor disk comprising a raised surface structure;

said first, second and third rotor disks together with at least two vanes defining a flow channel encompassing the raised surface structure of the third rotor disk;

said flow channel comprising a supersonic compression ramp;

wherein the at least two vanes are disposed in a screw-like fashion across the rotor surface defined by the first and second rotor disks and rotatably couple the first and second rotor disks, and wherein the raised surface structure is of dimensions such that it may not pass under a vane;

(b) positioning the raised surface structure of the third rotor disk within the flow channel downstream of a throat area of the flow channel during rotor start up; and (c) repositioning the raised surface structure of the third rotor disk within the throat area of the flow channel during steady state operation of the rotor.

* * * * *